US005620517A

United States Patent [19]

Saitoh

[11] Patent Number: 5,620,517

[45] Date of Patent: Apr. 15, 1997

[54] PAINTING DEVICE

[75] Inventor: Minoru Saitoh, Yamagata-ken, Japan

[73] Assignee: IG-Technical Research Inc., Japan

[21] Appl. No.: 470,028

[22] Filed: Jun. 6, 1995

[30] Foreign Application Priority Data

Sep. 14, 1994 [JP] Japan ..... 6-220609

[51] Int. Cl.[6] ..... B05C 3/02; B05C 3/10

[52] U.S. Cl. ..... 118/411; 118/410; 118/419

[58] Field of Search ..... 118/410, 411, 118/419

[56] References Cited

U.S. PATENT DOCUMENTS

| | | | |
|---|---|---|---|
| 2,349,256 | 5/1944 | Evans | 118/411 |
| 4,356,217 | 10/1982 | Wollam et al. | 427/286 |
| 4,411,218 | 10/1983 | Wollam et al. | 118/411 |
| 4,675,230 | 6/1987 | Innes | 118/411 X |
| 4,748,057 | 5/1988 | Kageyama et al. | 118/410 X |
| 4,907,530 | 3/1990 | Shibata et al. | 118/410 |
| 4,933,215 | 6/1990 | Naruse et al. | 118/411 X |
| 5,075,139 | 12/1991 | Crumbach et al. | 427/286 |
| 5,417,181 | 5/1995 | Idstein et al. | 118/419 X |

FOREIGN PATENT DOCUMENTS 64106 1/1989 Japan .

*Primary Examiner*—Arlen Soderquist

*Attorney, Agent, or Firm*—Michael D. Bednarek; Kilpatrick & Cody L.L.P.

[57] ABSTRACT

As a device used to paint a pattern such as a band, stripe or streak on the surface of an elongate and thin base material continuously supplied, a painting device is composed of at least a painting groove provided across the moving direction of the base material continuously supplied and having an opening formed along its both ends with a width wider than the width of the above-described base material in a manner not to be closed by the base material, a primary pipe communicated with the painted groove and a secondary pipe linked with the primary pipe, so that different kinds of paints are filled into the painting groove through the primary and secondary pipes to paint a pattern such as a band, stripe or streak over the whole surface of the base material in motion. With the opening formed at the both ends of the painting groove in the width direction with a width wider than the latter, it is possible to paint the wole surface of the base material through a single painting process without leaving unpainted areas. This structure prevents any area from being unpainted, eliminates a post-painting processing, and reduces cost and facilities.

9 Claims, 14 Drawing Sheets

PAINTING DEVICE

BACKGROUND OF THE INVENTION

1. Field of the Invention

This invention relates to a painting device to continuously form a pattern on the surface of a base material such as a thin metal sheet or a plastic film, more particularly a painting device to form a pattern such as a band, stripe or streak on a base material over the whole surface.

2. Prior Art

Conventionally, there has been known a painting device to continuously form a pattern such as a band, stripe or steak on an elongate base material with two kinds of paints used as described in Japanese Patent Publication No. Sho 64-106 which is shown in FIGS. 13 and 14. In this device, a painting groove b has its opening completely sealed off by a base material a and the base material a is continuously moved in a direction shown by an arrow while paints A and B in the painting groove b remains not completely agitated (where they are half mixed), so that a streak pattern is formed on the surface of the basic material a.

In the above-described device, it is essential that the width Wa of the base material a is wider than the width Wb of the painting groove b (Wa>Wb) since the base material a is required to constitute a closing wall to close the opening of the painting groove b. Therefore, the material a has its two sides in the width direction vulnerable to have an unpainted area c ($\Delta T$) left unpainted and painting cannot be applied to the base material a over the whole surface. Such an unpainted area c needs post-painting processing such as slitting, requiring additional facilities and higher cost.

SUMMARY OF THE INVENTION

With a view to the above-described conventional technique, this invention proposes a painting device comprising a painting groove wider than a base material in width and an opening provided along the both sides of the painting groove in the width direction not to be closed by a base material, which can paint the base material over its whole surface in a single process. As a result, the painting device according to the present invention can prevent the unpainted area from being generated, which eliminates post-painting processing and reduces facilities and cost.

In other words, a painting device according to the present invention comprises a painting groove provided across the moving direction of a base material which is continuously fed and having openings along its two sides made wider than the base material in the width direction not to be closed by the base material, and at least a primary pipe and a secondary pipe communicating with the painting groove and linked with the primary pipe to supply different kinds of paints respectively through the primary and secondary pipes to fill them in the painting groove and paint a pattern such as a band, stripe or streak over the whole surface of the base material in movement.

In a painting device as described above, there may be provided between the both ends of the painting groove a shallow portion having an opening to make the depth of the groove shallow. In this case, the presence of a step or the stricture of paint flow resulting from this shallow portion increases fluid viscosity resistance which serves to decrease the amount of paint freeing out of the opening, thereby effectively reducing the waste of a paint.

If the primary and secondary pipes are provided in plural sets and communicated with the painting groove with a desired pitch, furthermore, a base material with a wide width can be painted effectively without developing irregularities.

Furthermore, the painting groove may be formed on a head surface on one side of a substantially quadratic prism shape and the edge of the head surface on the side of a base material outlet is projected from the head surface and inclined toward the base material to form an inclined projecting portion. To smoothen and make even a painted layer formed on the base material after the painting through the painting groove, there may be employed a rolling bar or a rolling roller rotating in the same direction as the moving direction of the base material, or a rolling roller rotating in a direction opposite to the moving direction of the base material. All this modification is effective, particularly to form a complex pattern, raise painting quality from a designing view point and realize an aesthetic appearance.

The edge of the above-described head surface on the side of the base material outlet may be partially notched and inclined in a direction away from the base material to form a inclined notched surface through which another kind of paint is fed to the painting groove. With this, a painted surface can be finished with more sophisticated and aesthetically improved quality given.

In a painting device as described above, the base material is supported on the outer periphery of a rotatable supporting roller and fed by the rotation of the roller. The painting groove is provided in a gap over the outer periphery of the supporting roller where the base material comes in contact with the supporting roller. Preferably, a cleansing unit is provided in a gap over the outer periphery of the supporting roller where the base material does not come in contact with the supporting roller to wash off surplus paint attached through the openings of the painting groove. This cleansing unit removes surplus paint to keep the supporting roller, providing less frequent replacement of the supporting roller due to attached surplus paint, so that the maintainability will be improved.

A cleansing unit as described above is preferable from cleansing capability and structural simplicity if it is composed of a cleansing roller which, abutting against the supporting roller, rotates in association with the rotation of the supporting roller to wash off surplus paint attached to the supporting roller by using a cleansing agent permeated therethrough, a pallet keeping the cleansing agent to permeate through the cleansing roller and a doctor which removes unwanted matters stuck to the outer periphery of the supporting roller after the cleansing by the cleansing roller.

In a continuous painting line composed of an uncoiler taking out a base material stocked in the form of a coil, two groups of tension rollers with a plurality of tension driving rollers provided in a cranked form to move the base material under tension, a baking furnace provided between the front and rear groups of tension rollers to bake and dry paint applied to the surface of the base material, a cooling device provided between the front and rear groups of tension rollers to cool the base material after the baking and drying in the baking furnace and a recoiler to take in and stock the base material in the form of a coil, a painting device according to the present invention as described above can be built easily with the above-described driving rollers in the front group of tension rollers utilized as its supporting rollers, constituting a comprehensive continuous line of painting.

The present invention is not limited as described in above. Its further objects, advantages, characteristics and applications may be apparent from further description of the invention presented hereinlater with reference to the attached drawings. It should be noted that various alterations, modifications and changes to the invention may be possible without departing from the spirit and scope of the invention.

PREFERRED EMBODIMENTS OF THE INVENTION

The present invention will now be described with reference to the accompanied drawings which show painting devices embodying it in preferred forms.

Figure 1:
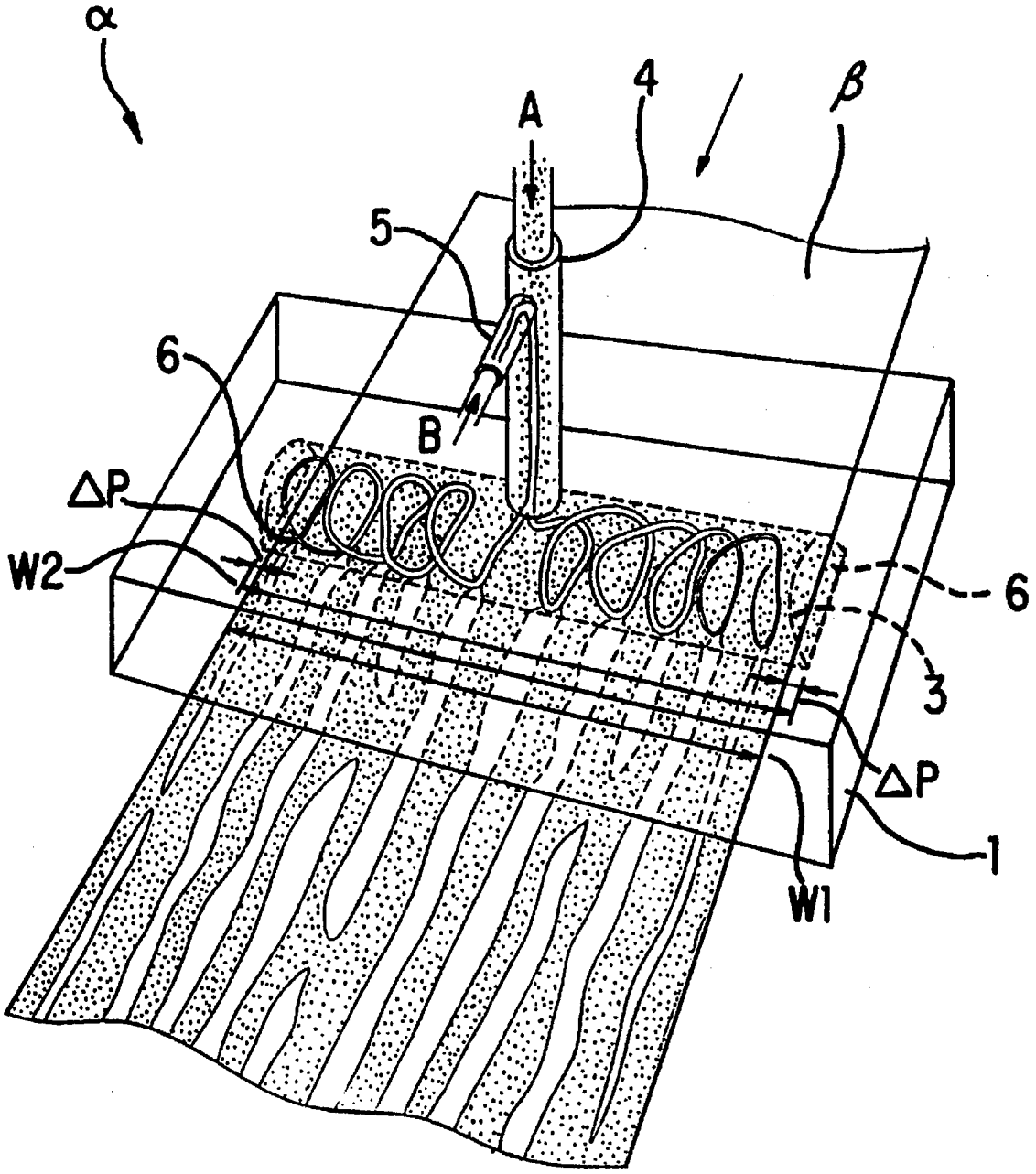
FIG. 1 is an explanatory view showing a typical painting device according to the invention.
Figure 2A:
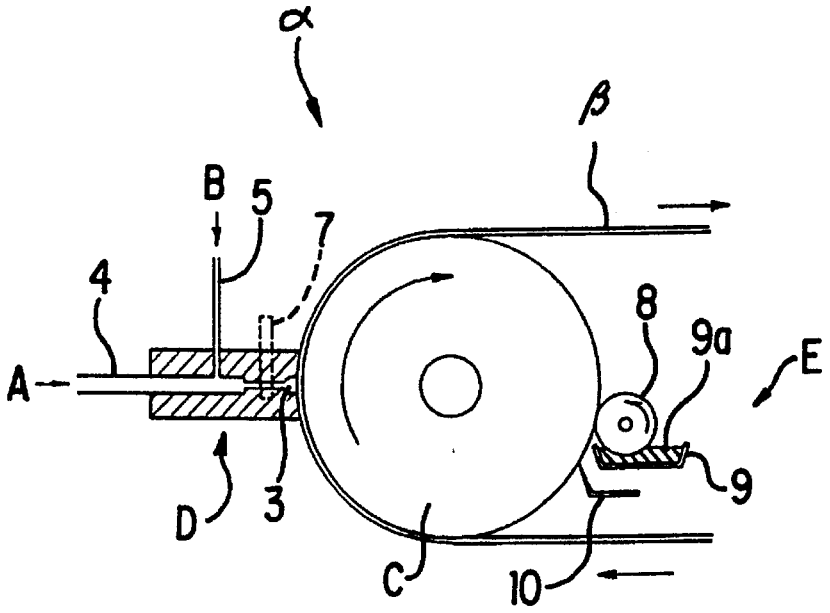
FIG. 2*a* and 2*b* are explanatory views showing another typical painting device according to the invention.

FIG. 1 is a perspective view schematically showing primary sections of a painting device α according to the invention. FIG. 2(*a*) is a cross-sectional view showing primary sections of the painting device α and FIG. 2(*b*) is a partially enlarged view of FIG. 2(*a*). Arrows in FIGS. 1 and 2 show the moving direction of a base material β, the rotational direction of each roller and flows of paints A and B.

The painting device α is primarily composed of a supporting roller C, a painting head D and a cleansing unit E to apply painting on the base material β elongate in shape continuously fed over the supporting roller C.

Made of such a material as a thin metal plate or plastic film, the base material β is elongate in shape, measuring approximately 0.2 to 1.5 mm thick. It is a base to be provided with a pattern of painting through the painting device.

The supporting roller C has a cylindrical shape. As shown in FIG. 2, it rotates in a direction shown by an arrow in contact with the back of the base material β to move the base material β to the next process (drying, baking, cutting, etc.). Applying tension to the base material β at the same time, the supporting roller C serves to stabilize the material base β in move and prevent the latter from zigzagging or bending.

Figure 2B:
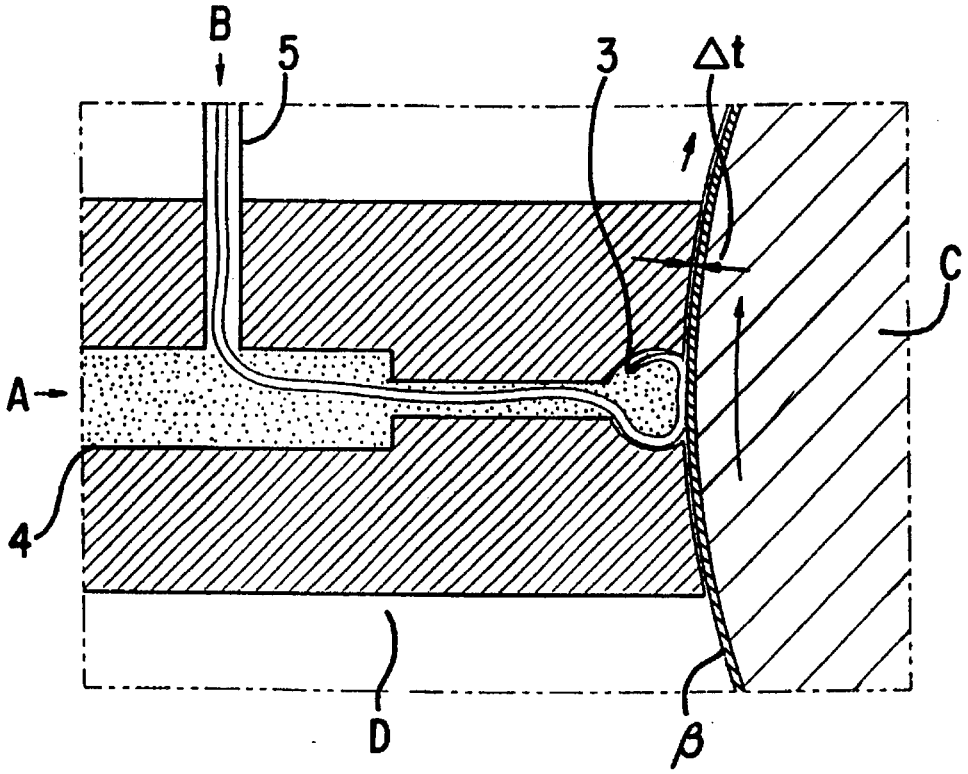
Figure 3:
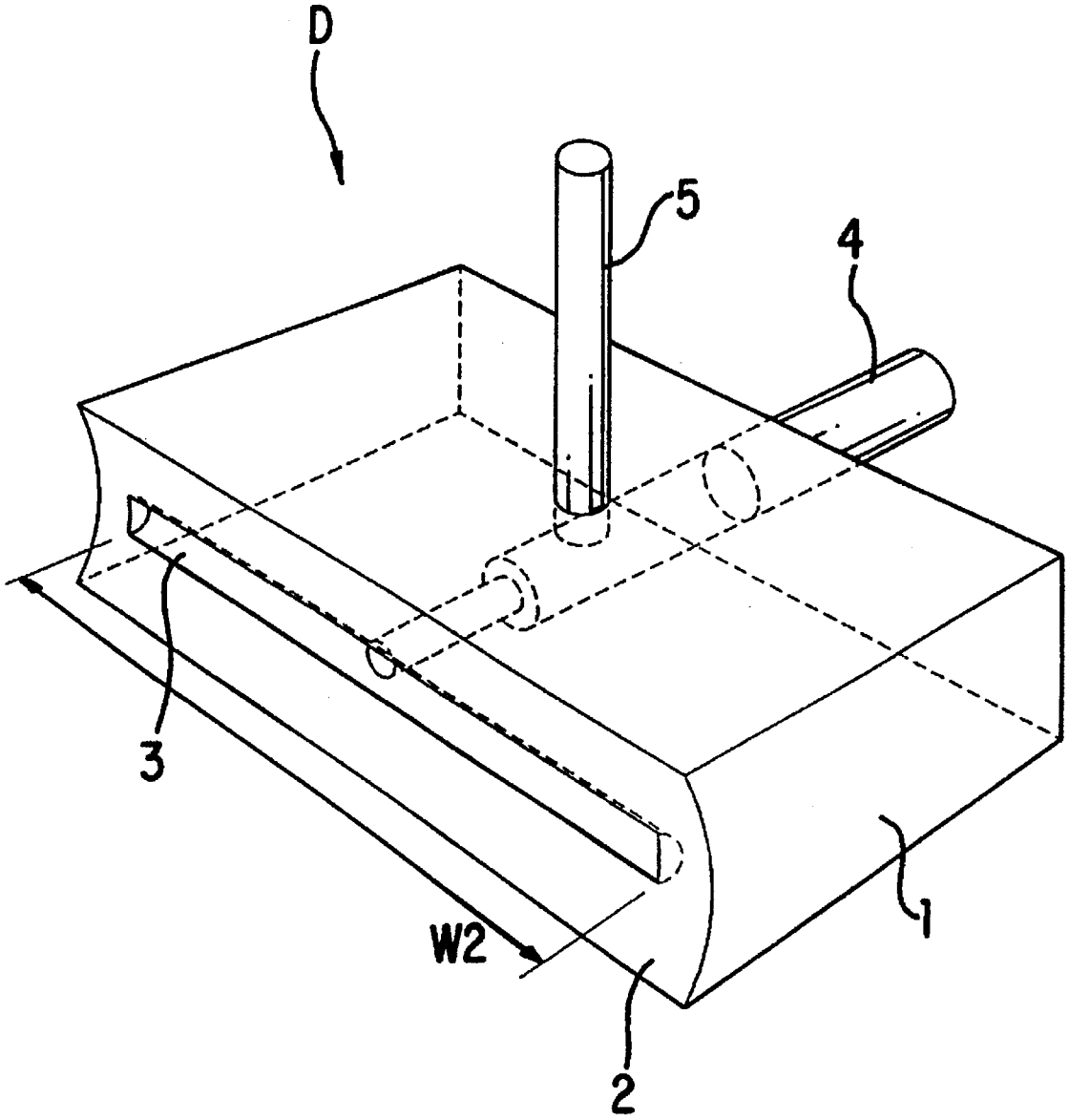
FIG. 3 is an explanatory view showing an example of a painting head constituting the painting device.

The painting head D, as shown in FIGS. 1 and 2, corresponds to an approximately semicircular supporting surface formed by the base material β and the supporting roller C in contact and is provided at a desired position in a gap over the outer periphery of the supporting roller C to paint a pattern over the whole surface of the base material β. As shown in FIG. 3, the painting head D in this embodiment is composed of a substantially quadratic prism-shaped die 1, a head surface 2 made with one side of the die 1 cut substantially identically to the diameter of the supporting roller C and a narrow painting groove 3 semicircular in cross section formed at approximately the center of the painting groove 3. A primary pipe 4 is communicated with the painting groove 3 from the bottom thereof at the center. This primary pipe 4 has a secondary groove 3. This primary pipe 4 has on the intermediate portion thereof a secondary pipe 5 in a communicated manner. As shown in FIG. 2(*b*), the head surface 2 of the painting head D is provided with a clearance of Δt from the base material β to determine the thickness of a painting pattern with this Δt.

There will now be described a mechanism how this painting device α forms a pattern. As shown in FIG. 1*a* and FIG. 2*b*, a paint A is fed from the primary pipe 4 and an another paint B having different color from the secondary pipe 5. These paints A and B are filled in the painting groove 3 and begin rotating in a half-mixed state(not completely mixed but half mixed) under the influence of the base material β moving in the longitudinal direction. Fed through there, the base material β has formed thereon a pattern of paint in a continuous form such as a band, stripe or streak. The paints A and B to be applied comprises at least more than one paint mixed, with the use of acrylic, urethane, epoxy, polyester and fluoroplastic paints at least different in color. These paints may have different characteristics, and either of the paints A and B can be a simple ink or pigment.

The width of this pattern in the form of a band, stripe or steak changes itself as the paints A and B mix progressively. The closer to the primary pipe 4, the width of the pattern becomes larger. It becomes narrower as the base materials moves closer to the end of the painting groove 3. A band, stripe or streak of painting changes its width and pitch, depending on the ratio of the paints A and B supplied, which can be adjusted as desired.

As shown in FIG. 1, the both ends of the painting groove 3 in the width direction are formed to constitute an opening 6 not to be closed by the base material β with the width W1 of the base material β and the width W2 of the painting groove 3 kept in a relationship W1<W2. With this structure, painting can be applied to the base material β0 evenly over the surface without developing irregularities or leaving unpainted areas. The width ΔP of the opening 6 at the sides of groove 3 is from 0.5 mm to 30 mm, preferably 3.0 mm.

Shown by dotted lines in FIG. 2(*a*) is a valve 7 which is provided as required to adjust the amount of the paints A and B to be supplied to the painting groove 3. More specifically, this valve 7 is composed of a rotary air valve. Furthermore, three or more paints different in kind can be used in a half-mixed state with a plurality of pipes such as a third pipe, a fourth pipe and so on (not shown) further connected to the primary pipe 4, in addition to the secondary pipe 5.

The cleansing unit E, as shown in FIG. 2(*a*), is provided against the supporting roller C at a desired position in a gap over the outer periphery of the supporting roller C where the supporting roller C and the base material β are not in contact. This cleansing unit E serves to wash off surplus paint stuck to the supporting roller C from the opening 6. For instance, the cleansing unit E is composed of a cleansing roller 8, a pallet 9 and a doctor 10. The cleansing roller 8 has its surface made of such a material as textile, foam plastic or rubber, which is excellent in permeability, and rotates in contact with the supporting roller C and in correspondence with the supporting roller C. While rotating, the supporting roller C becomes impregnated with a cleansing agent 9*a* filled in the pallet 9 and cleans off surplus paint stuck to the supporting roller C. The doctor 10, after cleaning by cleaning roller, scrubs off surplus paint or the cleansing agent 9*a* which becomes easy to come off due to the cleansing agent 9*a*, and eventually removes all unnecessary matters stuck to the surface of the supporting roller C. Depending on the characteristics of the paints A and B employed, an adequate material can be selected from, for example, water and paint thinner, as the cleansing agent 9*a*.

Figure 4:
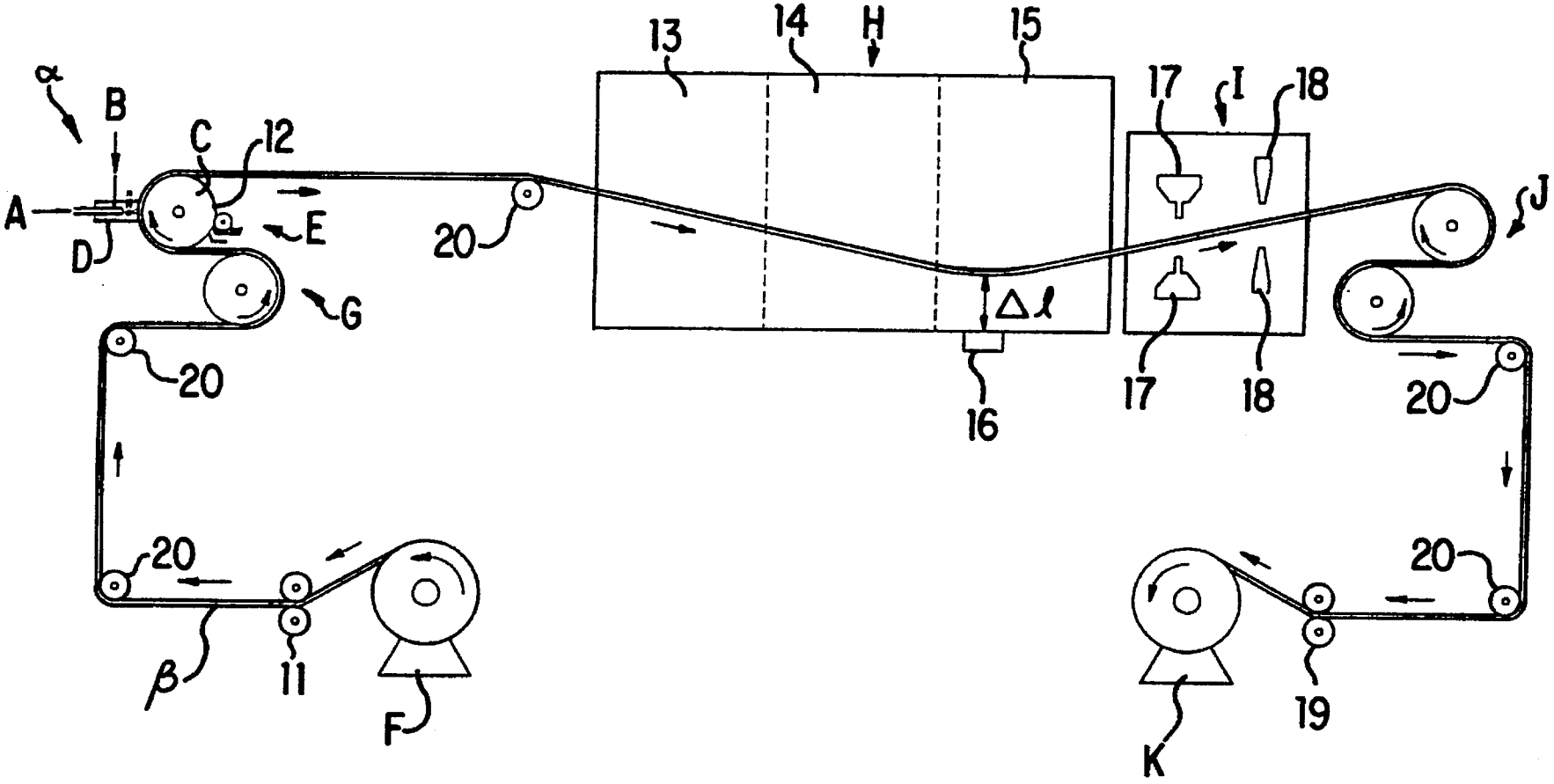
FIG. 4 is a schematic view showing the painting device built in a painting line.

FIG. 4 is an explanatory drawing showing the above-described painting device α as built in a continuous line of painting. This painting line comprises an uncoiler F, a front group of tension rollers G, a painting device α, a baking furnace H, and a cooling device I, a rear group of tension rollers J and a recoiler K. Arrows in the figure show the moving direction of the base materials β and the rotational direction of each device.

The uncoiler F takes out the base material β stocked in the form of a coil and transfer the base material β to the next process in collaboration with a pinch roller 11.

The front and rear groups of tension rollers G and J are provided therebetween with the painting device α, the baking furnace H and the cooling device I to exert a pulling force (tension) to the base material β. It is structured with a plurality of driving rollers 12 aligned. In this respect, the rotational speed of rollers in the front group G when slightly delayed behind the rotational speed of rollers in the group J is more effective.

The printing device α is provided in such a manner that it can utilize the driving rollers 12 in the front group of tension rollers G as its supporting rollers.

The baking furnace H bakes and dry the paint applied to the base material β. It has a sealed-off gap inside to keep a heated environment utilizing a heat generated by burnt gas. The interior of the gap is divided into sections with heat kept at three different levels, namely a drying section 13, a baking section 14 and a cooling section 15. Heat inside the gap is distributed in a mountain-like pattern reaching the highest level in the baking section 14. For example, the temperature is kept ranging from a room temperature to about 100 degrees Centigrade in the drying section 13, from about 100 degrees Centigrade to about 300 degrees Centigrade in the baking section 14 and from about 300 degrees Centigrade to about 200 degrees Centigrade in the cooling section 15.

Between this baking furnace H and the cooling device I, there is not provided anything like free rollers or conveyors to support the base material β, in order to keep heat transmission unblocked in the drying, baking and cooling conducted thereover and keep their drying, baking and cooling processing stable and efficient. Therefore, the base material β sinks and bends downward to a certain degree under its own weight. However, a sensor 16 is provided on the bottom of the printing device in correspondence to the top of the base material β in bending to monitor a clearance Δ1 between the bottom of the printing device and the top of the above-described bending of the base material β and to prevent the base material β from touching the bottom of the printing device.

The cooling device I has a sealed-off gap therein to cool base material β coming out from the baking furnace 7 to a room temperature. Inside the gap, there are provided on the both sides of the base material β, in order, a water sprayer 17 and a blow unit 18. The water sprayer 17 sprays water over the base material β to cool it down to a room temperature and, thereafter, the blow unit 18 blows pressurized air to blow off water from the base material β. At the bottom of the cooling device I, there is provided a pallet to recover water (not shown) which is linked through a water recovery pipe to a water tank serving which also serves as a chiller unit (not shown). In other words, there is provided a recycle system to return sprayed water to the water sprayer 17. Meanwhile, the blow unit 18 is linked to a pressurizing device such as a compressor.

The recoiler K takes in and stocks the base material conducted thereto through pinch rollers 19 after the completion of its painting.

Designated by reference numeral 20 in the figure is a free roller which is provided in plurality at desired positions except for the baking furnace H and the cooling device I. It serves as an auxiliary supporting means for the base material β.

Figure 11A:
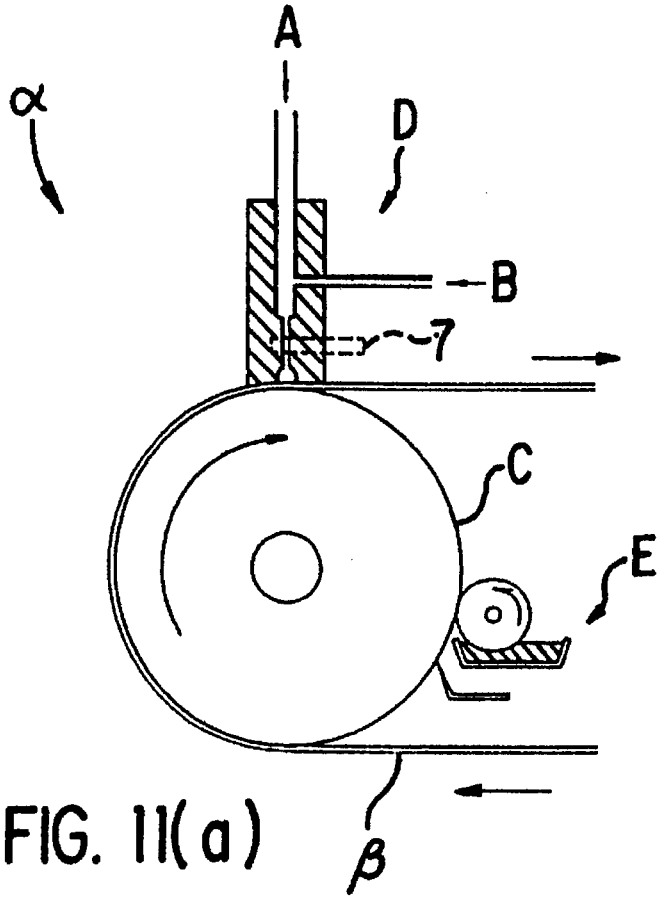
FIG. 11*a* and 11*b* are explanatory views showing another painting device of the invention.
Figure 11B:
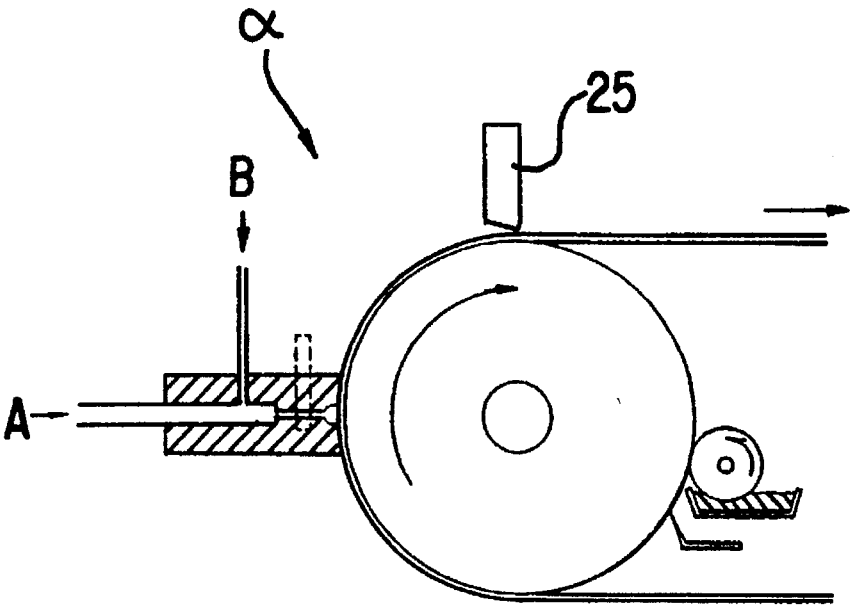
Figure 12A:
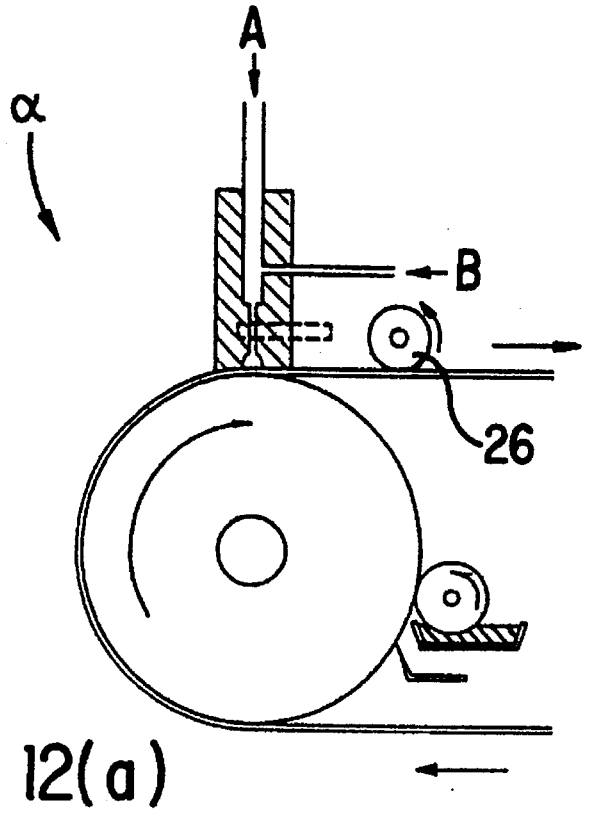
FIG. 12*a* and 12*b* are explanatory views showing yet another painting device of the invention.
Figure 12B:
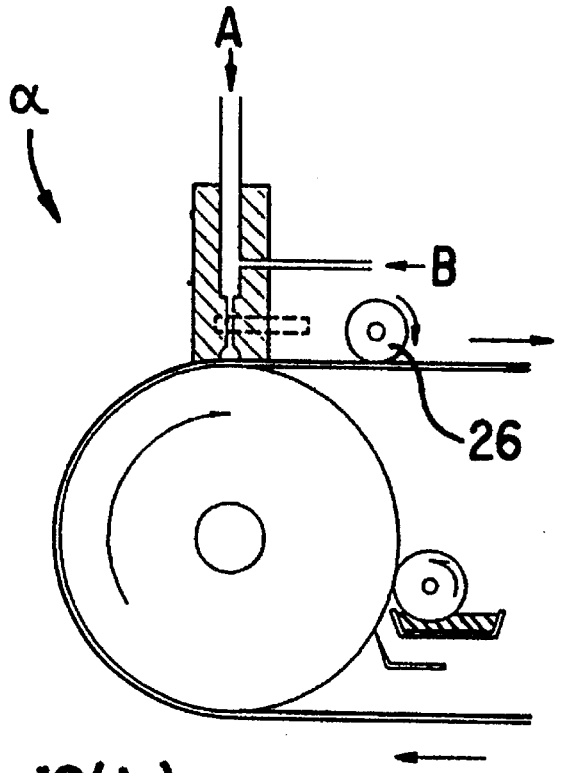
Figure 13:
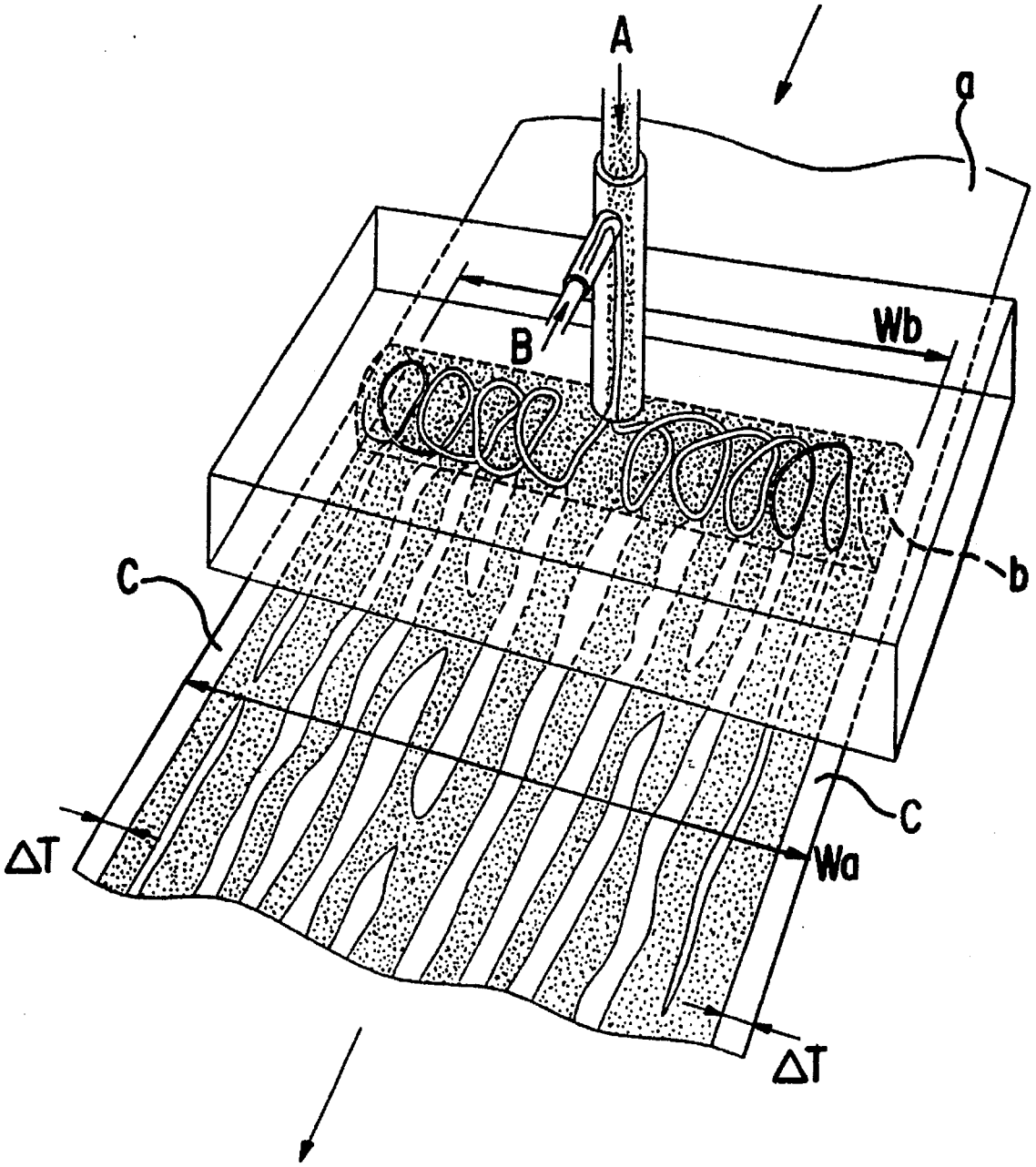
FIG. 13 PRIOR ART
FIG. 13 is an explanatory view showing a conventional painting device.
Figure 14A:
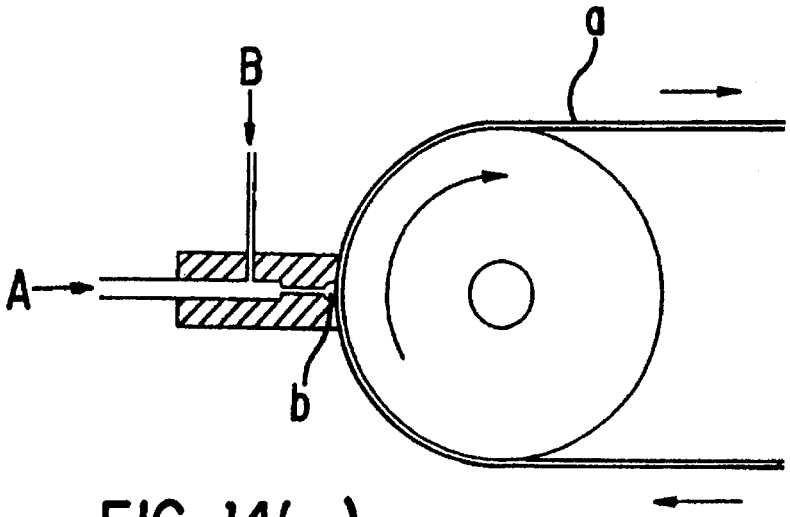
FIG. 14(a) PRIOR ART
FIG. 14*a* and 14*b* are explanatory views showing another conventional painting device.
Figure 14B:
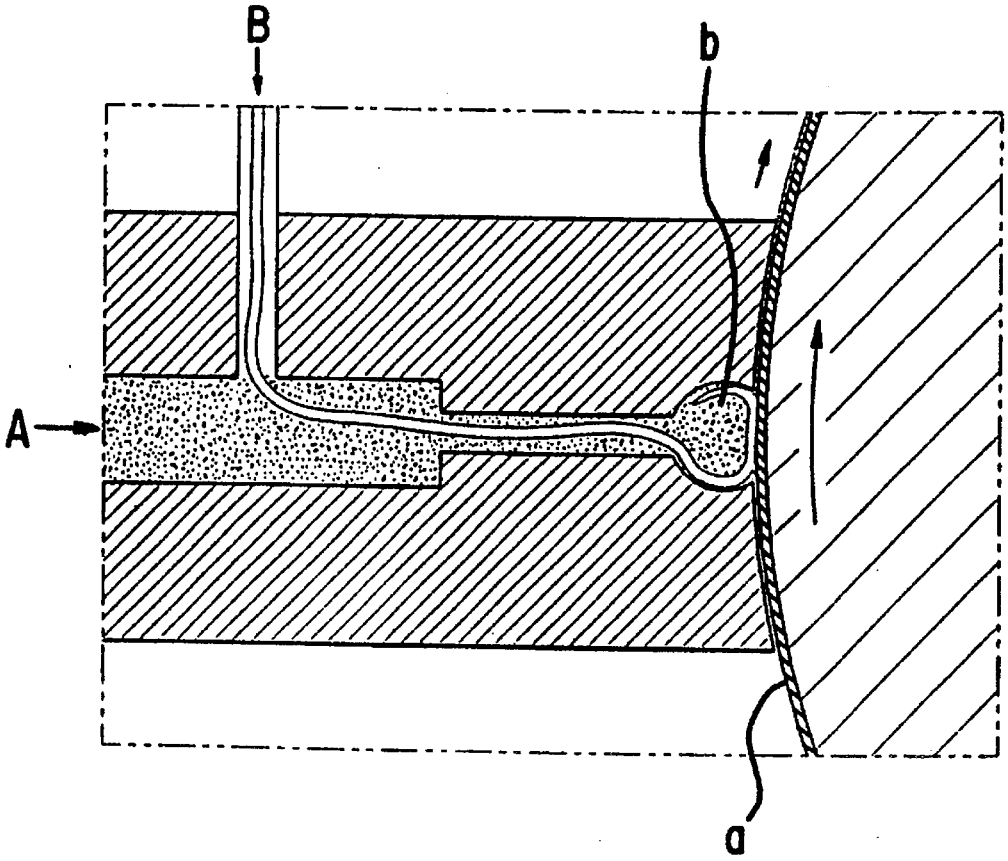
FIG. 14(b) PRIOR ART

The painting device α described above represents merely a preferred embodiment of the present invention but in no way limits the scope of the invention. For example, the invention can be embodied into a painting device α with a painting head D as shown in FIGS. 5 to 10 or a painting device as shown in FIGS. 11 and 12. These embodiments of the present invention will be described furthermore in detail.

Figure 5A:
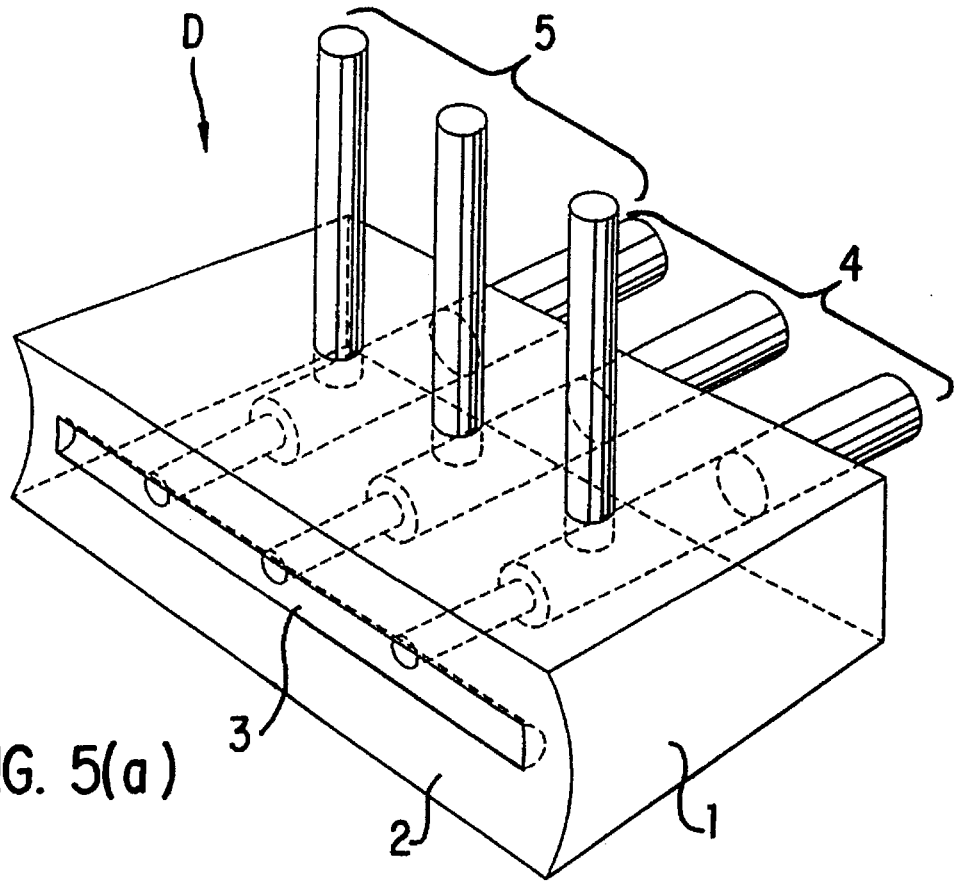
FIG. 5*a* and 5*b* are explanatory views showing another painting head constituting the painting device.
Figure 5B:
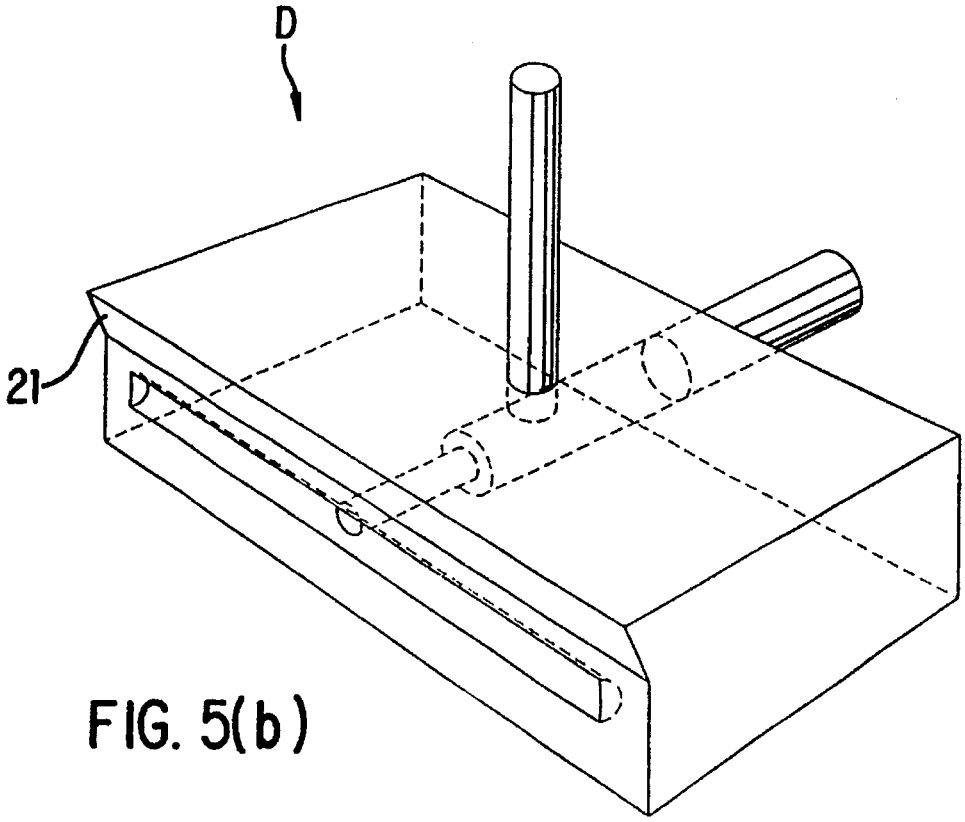

Shown in FIG. 5(*a*) is a painting head D with the front and rear groups of pipes 4 and 5 linked to the painting groove 3 with a pitch provided therebetween as desired. This structure is particularly effective when the base material β is big in width. FIG. 5(*b*) shows a painting head D having an inclined projecting surface 21 inclining in a direction toward the base material β, which is formed with the edge of the edge of the head surface 2 on the side of a base material β outlet projected from the head surface 2. This particular structure is effective to keep the thickness of painting applied to the base material β even and constant.

Figure 6A:
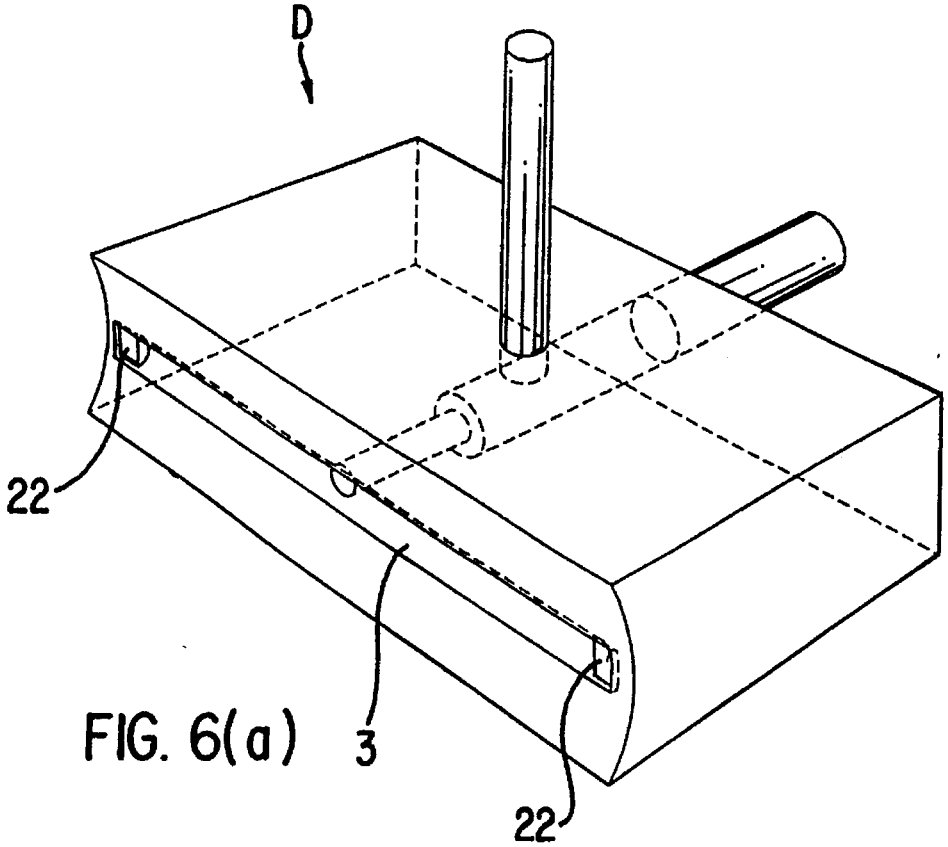
FIG. 6*a* and 6*b* are explanatory views showing yet another painting head constituting the painting device.
Figure 6B:
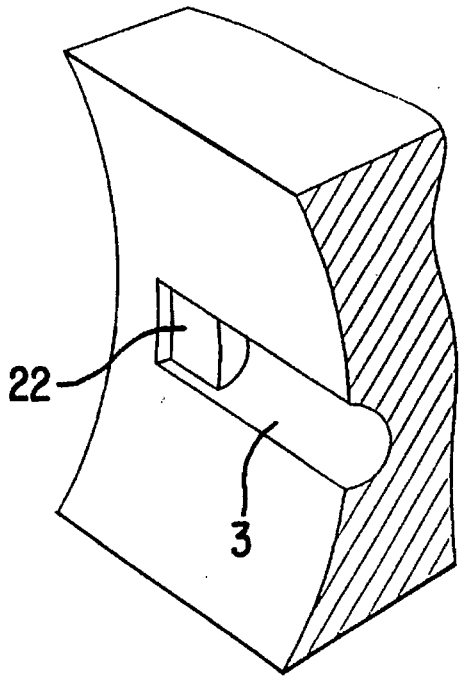
Figure 7A:
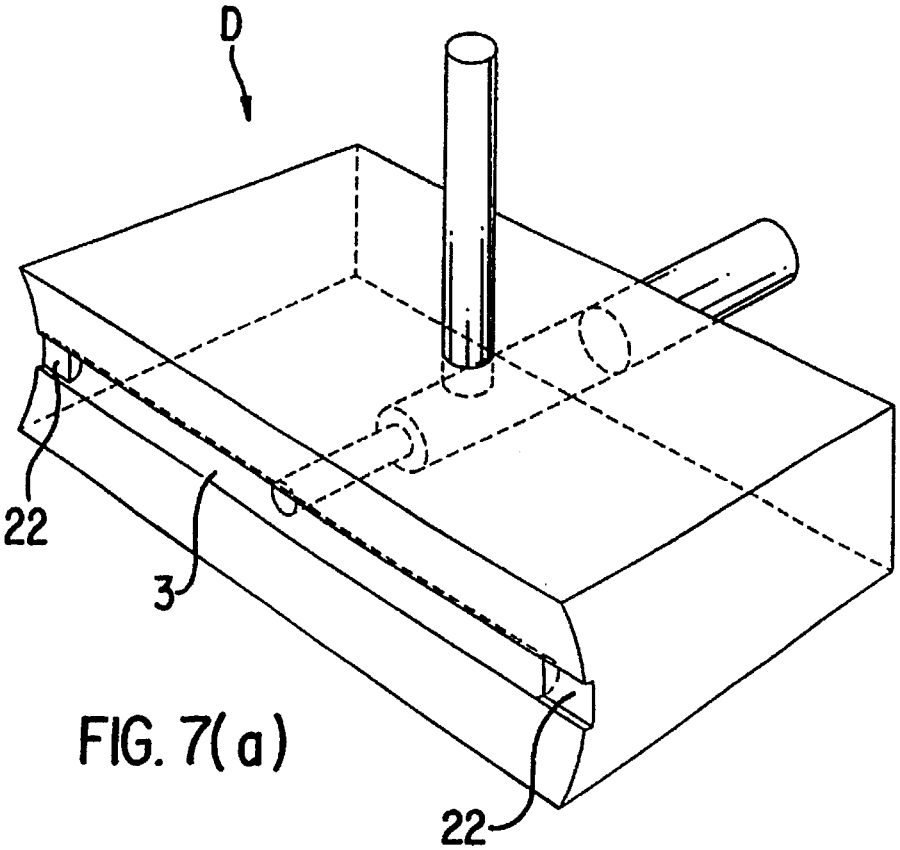
FIG. 7*a* and 7*b* are explanatory views showing further yet another painting head constituting the painting device.
Figure 7B:
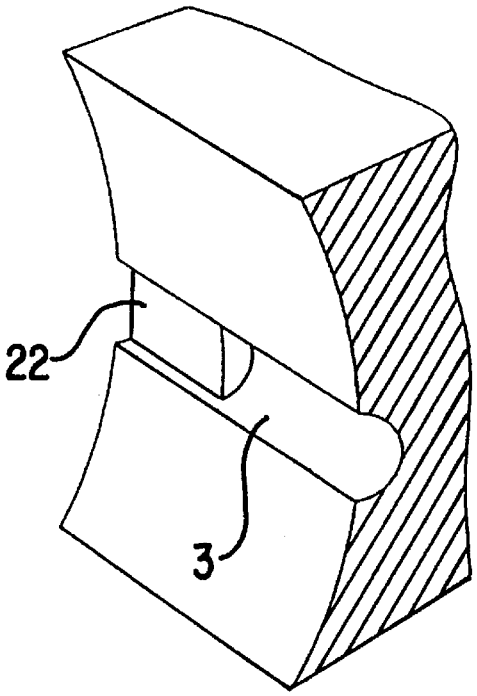

Shown in FIG. 6(*a*) and FIG. 7(*a*) are painting heads which, as clear from FIG. 6(*b*) and FIG. 7(*b*) which are enlarged views of them, have a shallow portion with the depth of the painting groove 3 made shallow at a position forming the opening 6. The presence of a step at the shallow portion or the stricture of a paint flow resulting from this shallow portion increases fluid viscosity resistance which serves to decrease the amount of a paint freeing out of the opening, effectively reducing the waste of a paint. A painting head shown in FIG. 6 has a head surface 2 left remaining outside the both ends of the printing groove 3. A painting head shown in FIG. 7 has a shallow portion 22 extended over between the both ends of the head surface 2.

Figure 8:
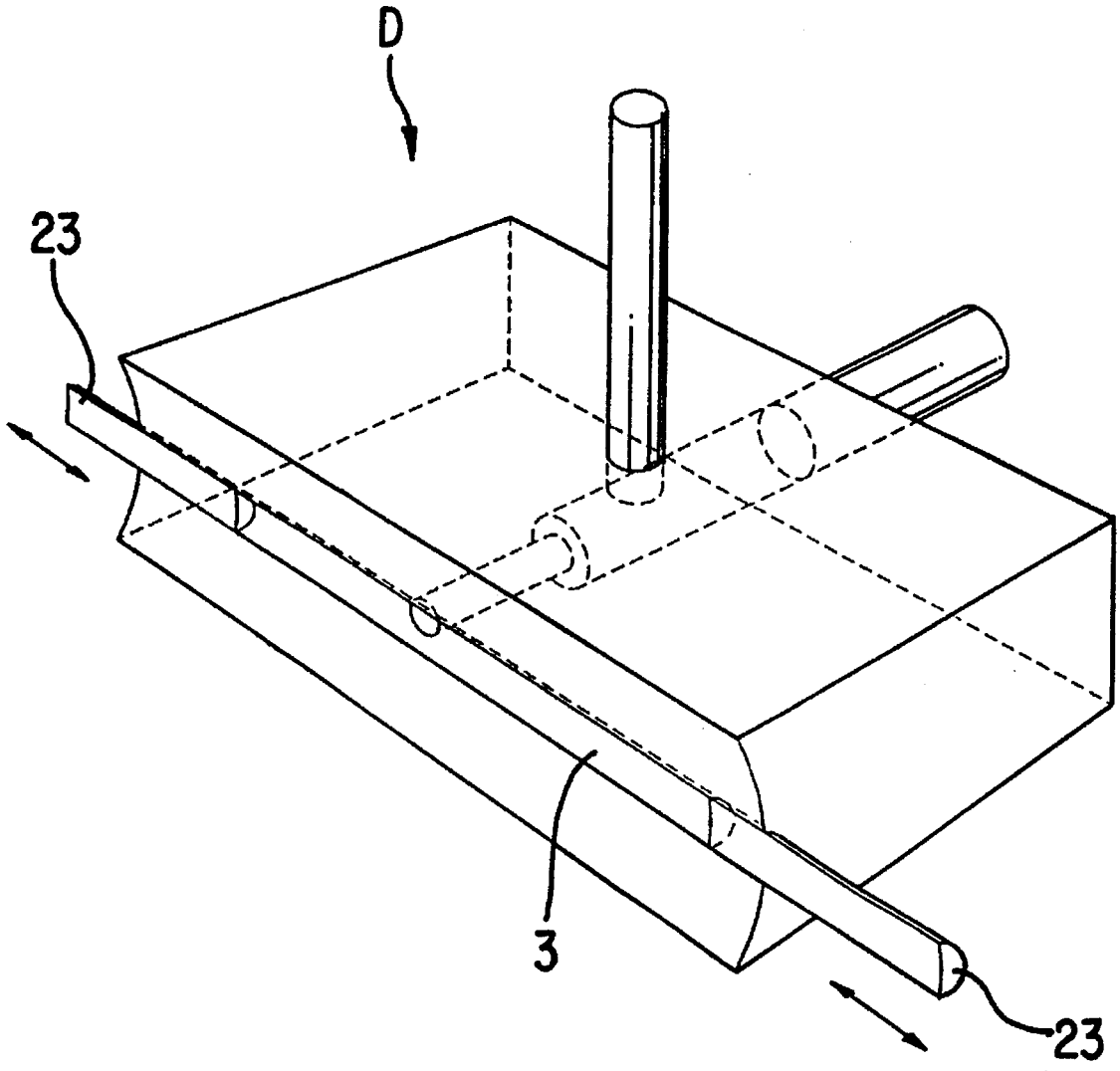
FIG. 8 is an explanatory view showing another painting head constituting the painting device.

FIG. 8 shows a printing head D which is formed with the painting groove 3 extended to the both ends of the head surface 2 and a groove width adjusting rod 23 with a cross-sectional shape corresponding to the cross section of the painting groove respectively inserted from the both ends of the painting groove to be slidable in a direction shown by an arrow. This embodiment allows facilitated adjustment of the width of painting to match a change in the width of the base material β.

Figure 9A:
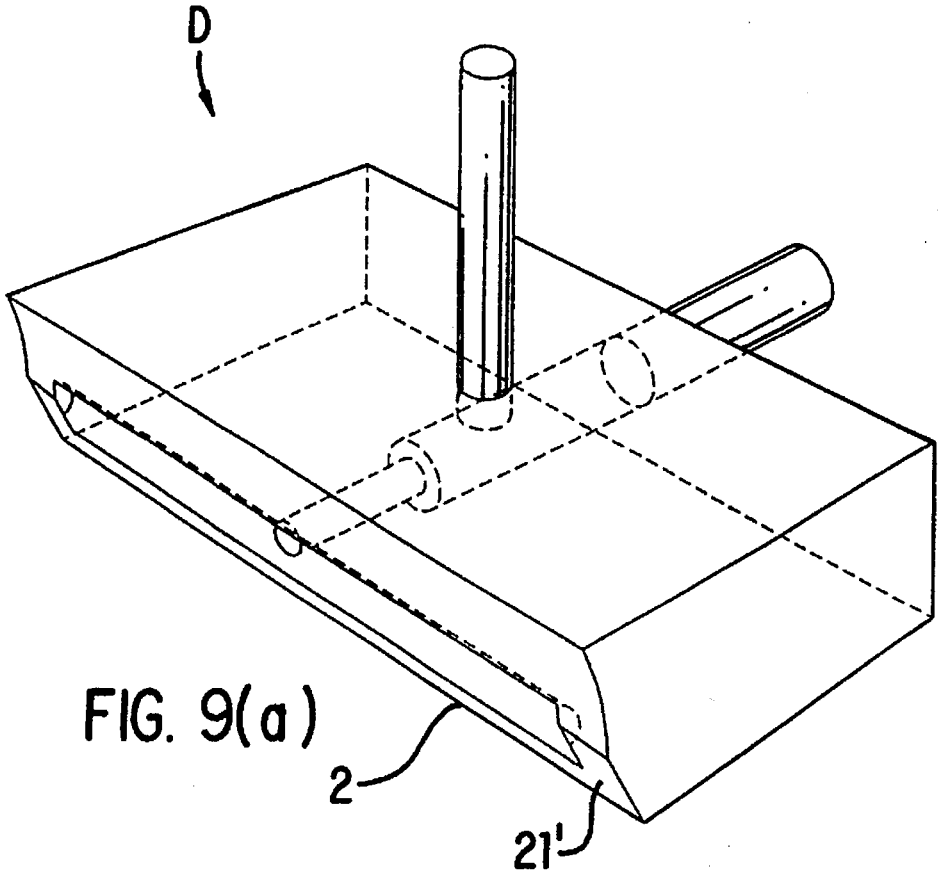
FIG. 9*a* and 9*b* are explanatory views showing yet another painting head constituting the painting device.
Figure 9B:
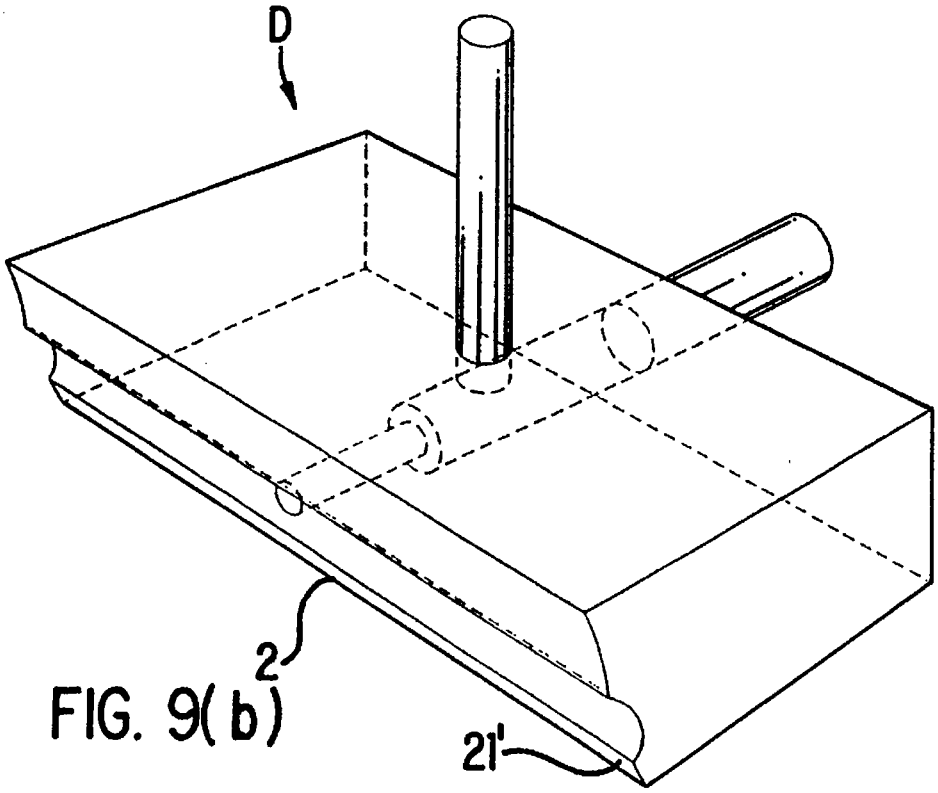
Figure 10A:
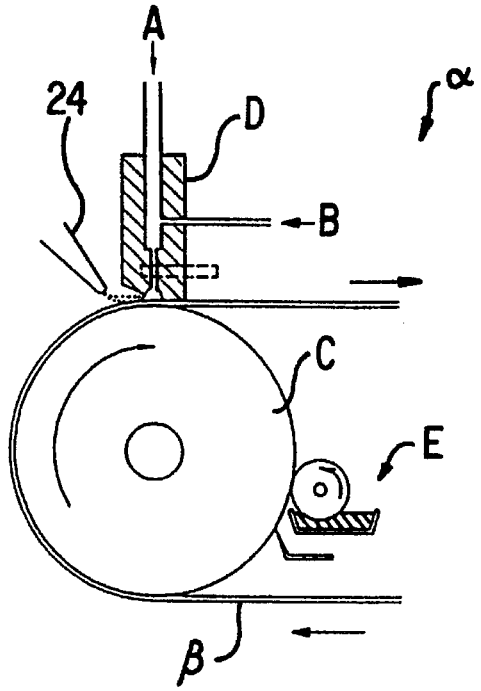
FIG. 10*a* and 10*b* are explanatory views showing a painting device employing the painting head of FIG. 9.
Figure 10B:
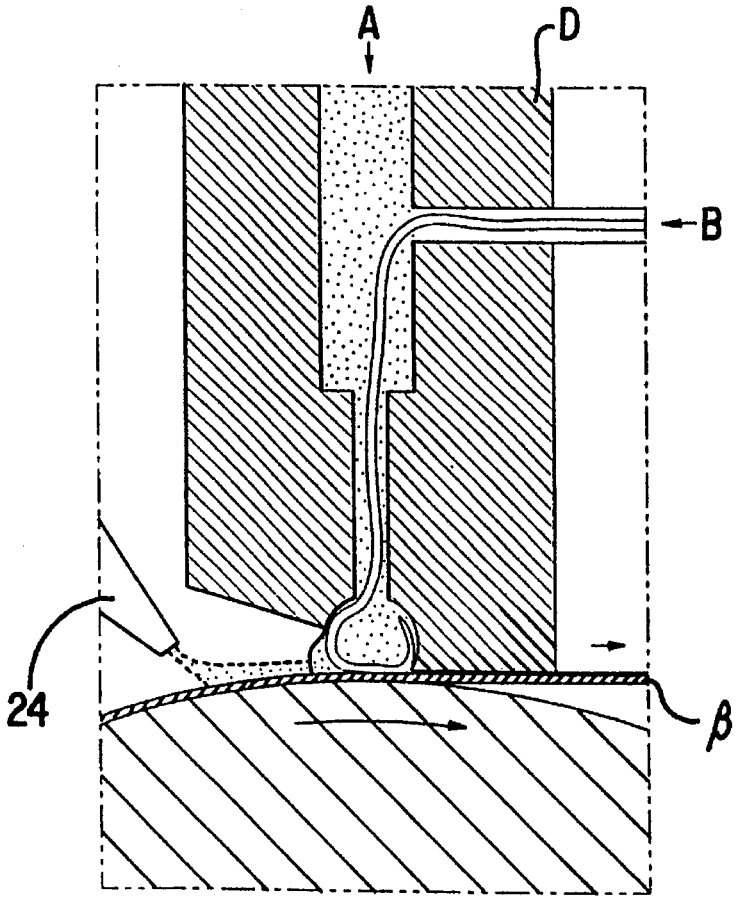

Shown in FIG. 9(*a*) and FIG. 9(*b*) is a painting head D which is formed with a inclined cut-off surface 21' with the edge of the head surface 2 on the side of a base material β inlet cut off and inclined in a direction opposite to the base material β. When this painting head D is used, a separate paint supply unit 24 is employed before (ahead of) the painting head D as shown enlarged in FIG. 10(*b*) to supply another kind of paint to the painting groove 3 through the inclined cut-off surface 21' formed on the head surface 2. This allows more sophisticated painting with enhanced design. FIG. 11(*a*) shows a painting device a with the painting head D provided above the supporting roller C and FIG. 11(*b*) another painting device α having an spreading bar 25 provided above the supporting roller C to roll over the coating of painting formed on the surface of the base material β under the spreading bar to make its thickness even and constant. A painting device shown in FIG. 12(*a*) and FIG. 12(*b*) has a spreading roller 26 provided behind the painting head D to roll over the coating of painting formed on the surface of the base material β to make its thickness even and constant. In a painting device shown in FIG. 12(*a*), a spreading roller 26 is provided to rotate in the moving direction of the base material β. FIG. 12(*b*) shows another embodiment the spreading roller 26 is rotated in a direction opposite to the moving direction of the base material β. These embodiments are effective to realize an aesthetically excellent appearance given with even and constant painting made possible in more sophisticated design.

It is needless to say that the above-described structures can be combined in various ways to make a painting device as desired.

As explained in the above, a painting device is provided with an opening wider than the width of a base material realizes desired painting over the whole surface of the base material through single processing. Thus, it eliminates post-painting processing such as slitting, requiring no additional facilities and higher cost.

What is claimed is:

1. A painting device for painting a pattern on a surface of a base sheet material, comprising:

paint head including:

a painting groove extending transverse to a feeding direction of the base sheet material through which a paint is fed for painting the base sheet material, the painting groove being wider than a width of said base sheet material, and at least one primary paint pipe communicating with said painting groove, and at least one secondary paint pipe connected with said at least one primary paint pipe;

means for feeding the base sheet material comprising a supporting feed roller; and a cleaning unit for cleaning paint from said support feed roller, said cleaning unit comprising:

a pallet for retaining a cleaning agent therein;

a cleaning roller in contact with said supporting feed roller and said pallet, whereby the cleaning agent retained in said pallet is carried by said cleaning roller and transferred to said supporting feed roller for cleaning said supporting feed roller; and a doctor constructed and arranged to scrape said supporting feed roller at a location on said supporting feed roller at a location following contact with said cleaning roller, relative to a direction of rotation of said supporting feed roller.

2. The painting device as claimed in claim 1, wherein opposite ends of said painting groove have shallow portions.

3. The painting device as claimed in claim 1, wherein a plurality of said primary and secondary pipes are provided with a desired pitch provided therebetween.

4. The painting device as claimed in claim 1, wherein said paint head is a substantially quadratic prism, wherein said painting groove is provided on one side of said substantially quadratic prism, wherein said side of said substantially quadratic prism on which said painting groove is provided is further provided with a projecting surface inclined toward a trailing edge of said paint head, relative to the feeding direction of said base sheet material.

5. The painting device as claimed in claim 1, wherein said paint head is a substantially quadratic prism, wherein said painting groove is provided on one side of said substantially quadratic prism, wherein an inclined notched surface is formed at a leading edge of said one side of said paint head.

6. The painting device as claimed in claim 5, further comprising a paint supply unit independent from said paint head and being constructed and arranged to supply a paint to said painting groove through said inclined notched surface.

7. The painting device as claimed in claim 1, further comprising a spreader bar constructed and arranged to contact the coating of paint on said base sheet material deposited thereon by said painting groove, thereby making the coating of paint uniform.

8. The painting device as claimed in claim 1, further comprising a spreading roller constructed and arranged to forwardly rotate in correspondence with the feeding direction of said base sheet material and contact the coating of paint on the surface of said base sheet material deposited thereon by said painting groove, thereby making the coating of paint uniform.

9. The painting device as claimed in claim 1, further comprising a spreading roller constructed and arranged to reversely rotate in opposition to the feeding direction of said base sheet material and contact the coating of paint on the surface of said base sheet material deposited thereon by said painting groove, thereby making the coating of paint uniform.

* * * * *